US006050304A

United States Patent [19]

Schiller et al.

[11] Patent Number: 6,050,304

[45] Date of Patent: Apr. 18, 2000

[54] WEAVING LOOM, PARTICULARLY AN AIR NOZZLE WEAVING LOOM

[75] Inventors: Peter Schiller; Hubertus Ludwig, both of Lindau; Hubert Ortmann, Heimenkirch, all of Germany; Josef Hehle, Hoerbranz, Austria

[73] Assignee: Lindauer Dornier Gesellschaft mbH, Lindauer, Germany

[21] Appl. No.: 09/198,447

[22] Filed: Nov. 24, 1998

[30] Foreign Application Priority Data

Nov. 28, 1997 [DE] Germany ..... 297 21 042 U

[51] Int. Cl.[7] ..... D03D 47/30

[52] U.S. Cl. ..... 139/435.3; 226/97.4

[58] Field of Search ..... 139/435.5, 453, 139/435.3, 435.4; 226/97.4; 28/255, 272

[56] References Cited

U.S. PATENT DOCUMENTS

| | | | |
|---|---|---|---|
| 4,366,845 | 1/1983 | Simson | 139/435 |
| 4,669,514 | 6/1987 | Manders | 139/435 |
| 4,850,398 | 7/1989 | Van Bogaert | 139/435 |
| 4,967,807 | 11/1990 | Lewyllie et al. . | |
| 5,056,566 | 10/1991 | Salomez . | |
| 5,295,515 | 3/1994 | Kato . | |

FOREIGN PATENT DOCUMENTS

| | | |
|---|---|---|
| 0 310 804 | 4/1989 | European Pat. Off. . |
| 27 41 859 | 3/1978 | Germany . |
| 38 15 088 | 12/1989 | Germany . |
| 6-220745 | 9/1994 | Japan . |
| WO 82 03641 | 10/1982 | WIPO . |

*Primary Examiner*—Andy Falik

*Attorney, Agent, or Firm*—Evenson, McKeown, Edwards & Lenahan, P.L.L.C.

[57] ABSTRACT

An air nozzle weaving loom has a prenozzle alignment arrangement for the weft yarn picking. Several prenozzles (8*a*) having respective blow pipe (8*b*) are accommodated in a prenozzle block 9 according to an order system (geometric configuration) corresponding to the order system (geometric configuration) of main nozzles (5*a*) in the main nozzle block (6).

18 Claims, 2 Drawing Sheets

WEAVING LOOM, PARTICULARLY AN AIR NOZZLE WEAVING LOOM

BACKGROUND AND SUMMARY OF THE INVENTION

This application claims the priority of German patent 297 21 042.4, filed Nov. 28, 1997, the disclosure of which is expressly incorporated by reference herein.

The invention relates to a weaving loom, particularly an air nozzle weaving loom, having a reed strip which carries a weaving reed and which, for the purpose of picking and looping weft yarns to the beating up edge of a weft, carries out uniform swinging motions from a picking position into a beating up position and in the reverse direction about a longitudinal axis of a driving or reed shaft, having a first nozzle arrangement which consists of several main nozzles having a blow pipe, the main nozzles being accommodated in a main nozzle block according to an order system, and the main nozzle block being connected with the reed strip carrying out the swinging motions, and having a second stationary nozzle arrangement which is situated in front of the first nozzle arrangement in the weft direction and consists of several prenozzles with a blow pipe, the yarn guiding duct of each blow pipe of the respective prenozzle, at the point in time of the picking of the weft yarn, being situated, aligned with the yarn guiding duct of the blow pipe, opposite the respective main nozzle.

For the picking of the woof yarn, known air nozzle weaving looms have a main nozzle block with several main nozzles with a blow pipe of a defined length which are accommodated according to a defined order system and can be acted upon pneumatically, the respective blow pipe aiming at the weft picking duct of a weaving reed. The main nozzle block is arranged on the reed strip of the weaving loom carrying the weaving reed, specifically such that the main nozzle block can be adjusted relative to the weaving reed.

For implementing a high woof picking performance, it is known to assign to each main nozzle integrated in the main nozzle block a separately arranged prenozzle which, viewed in the picking direction of the weft yarn, is positioned at a distance in front of the respective main nozzle.

The respective prenozzle has a blow pipe of a defined length which is aligned in the direction of the respective main nozzle such that weft yarn deflections, which damage the weft yarn, are largely avoided.

In this case, the alignment of the respective prenozzle with the concerned main nozzle is time-consuming, specifically if a large number of prenozzles must be aligned with a corresponding large number of main nozzles.

In view of this background, it is an object of the invention to provide a prenozzle arrangement which eliminates the need for individual alignment of each prenozzle with the pertaining main nozzle and which avoids weft yarn deflections between the prenozzles and the main nozzles during the weft yarn picking.

According to the invention, this object is achieved in that the individual prenozzles with the blow pipe are accommodated in a prenozzle block according to an order system (geometric configuration) which corresponds to the order system (geometric configuration) of the main nozzles in the main nozzle block, which order system has the result that, with the alignment of a single prenozzle with the corresponding main nozzle, all other prenozzles during the picking of the weft yarn are aligned with the corresponding main nozzles, specifically also if the prenozzle block is mounted on a stationary carrier which is independent of the reed stay.

These objects have also been achieved according to the present invention by providing an air nozzle weaving loom, having a reed stay which carries a weaving reed and which uniformly swings between a picking position and a beating up position about a longitudinal axis of a driving shaft in order to pick and beat up weft yarns, having a first nozzle arrangement including a plurality of main nozzles having respective main nozzle blow pipes, the main nozzles being positioned in a main nozzle block in a given geometric configuration, and the main nozzle block being fixedly connected with the reed stay, and having a second stationary nozzle arrangement which is situated in front of the first nozzle arrangement in a weft direction and includes a plurality of prenozzles with respective prenozzle blow pipes, a yarn guiding duct of each of said prenozzle blow pipe being aligned in a weft yarn picking position with a respective yarn guiding duct of the main nozzle blow pipe, opposite the respective main nozzle, wherein the prenozzles with the prenozzle blow pipes are positioned in a prenozzle block in a geometric configuration which corresponds to said given geometric configuration of the main nozzles, the prenozzle block being connected with a weaving loom carrier, wherein an alignment of the yarn guiding duct of a single one of said prenozzles with the yarn guiding duct of a corresponding one of the main nozzles effects an alignment of all of the yarn guiding ducts of the prenozzles with the corresponding main nozzles.

These objects have also been achieved according to the present invention by providing an arrangement of main nozzles and prenozzles in an air weaving loom, comprising: a main nozzle block including a plurality of main nozzles extending there through in a weft direction, said plurality of main nozzles being arranged in a given geometric configuration with respect to a longitudinal center axis of said main nozzle block; a prenozzle block arranged upstream of said main nozzle block with respect to said weft direction, said prenozzle block including a plurality of prenozzles extending therethrough in said weft direction, said plurality of prenozzles being arranged in a geometric configuration with respect to a longitudinal center axis of said prenozzle block which corresponds to said given geometric configuration of said main nozzles.

These objects have also been achieved according to the present invention by providing a prenozzle arrangement for an air weaving loom having a main nozzle block including a plurality of main nozzles extending therethrough in a weft direction, said plurality of main nozzles being arranged in a given geometric configuration with respect to a longitudinal center axis of said main nozzle block, said prenozzle arrangement comprising: a prenozzle block to be arranged upstream of said main nozzle block with respect to said weft direction, said prenozzle block including a plurality of prenozzles extending therethrough in said weft direction, said plurality of prenozzles being arranged in a geometric configuration with respect to a longitudinal center axis of said prenozzle block which corresponds to said given geometric configuration of said main nozzles.

These objects have also been achieved according to the present invention by providing a method of making a prenozzle for an air weaving loom having a main nozzle block including a plurality of main nozzles extending therethrough in a weft direction, said plurality of main nozzles being arranged in a given geometric configuration with respect to a longitudinal center axis of said main nozzle block, said method comprising: providing a prenozzle block having a longitudinal center axis; and arranging a plurality of prenozzles in said prenozzle block in a geometric configuration with respect to said longitudinal center axis which corresponds to said given geometric configuration of the main nozzles.

In a further development of the invention, in the case of a corresponding order system, the prenozzle block can be arranged on the carrier stationarily connected with the weaving loom, the prenozzle block being rotatable about its longitudinal center axis.

A defined order system of the prenozzles and the main nozzles exists, for example, if the center axes of the nozzles are arranged symmetrically about the longitudinal center axis of the nozzle blocks on a circular path.

In such a case, by the rotation of the prenozzle block about its longitudinal center axis, each prenozzle can be assigned to an arbitrary or selected one of the main nozzles. Such an approach can be significant when weft yarns of different qualities are to be made into a woven fabric, and, for example, a weft yarn requires a prenozzle which deviates in its construction from the main nozzle. The corresponding prenozzle can then be assigned to the respective main nozzle within a short time period.

Thus, it is important with respect to the invention that, with the alignment of a single prenozzle with the corresponding main nozzle, all other prenozzles are necessarily aligned with their assigned main nozzles.

The solution according to the invention advantageously eliminates the separate alignment of the large number of prenozzles with the corresponding main nozzles, and weft yarn deflections between the prenozzle arrangement and the main nozzle arrangement which damage the weft yarn during the picking of the woof yarn are eliminated.

Other objects, advantages and novel features of the present invention will become apparent from the following detailed description of the invention when considered in conjunction with the accompanying drawings.

DETAILED DESCRIPTION OF THE DRAWINGS

Figures 1, 2:
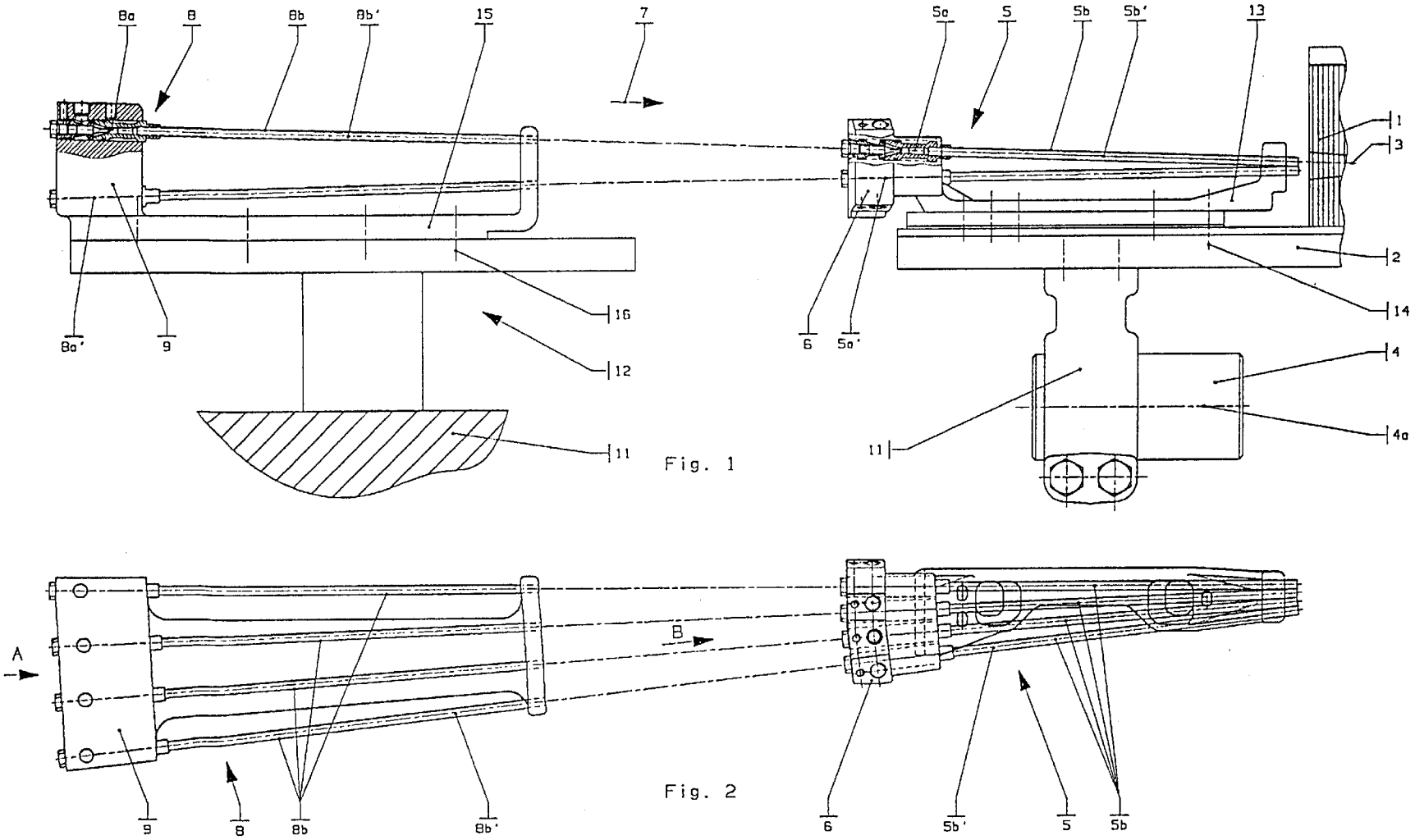
FIG. 1 is a side view of the main nozzle block and the prenozzle block with main nozzles and prenozzles in a separate arrangement.
FIG. 2 is a top view of the main nozzle block and the prenozzle block with main nozzles and prenozzles.

In FIG. 1, the only partially illustrated weaving reed 1 is mounted on the so-called reed stay 2 of a weaving loom 11, which is not shown here in further detail.

A main nozzle arrangement 5 is detachably connected with the reed stay 2 in front of the weaving reed 1 in the weft direction 7.

Together with the weaving reed 1, the reed stay 2 swings periodically for the purpose of the beating up of weft yarns 3 to the beating up edge of a weft not shown here about the longitudinal axis 4*a* of a driving or reed shaft 4. The main nozzle arrangement 5 therefore swings also in the moving rhythm of the reed stay 2 about the axis 4*a*.

Figure 4:
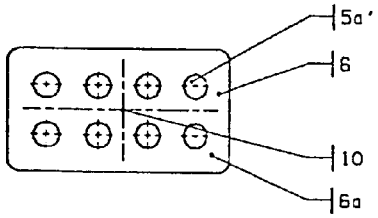
FIG. 4 is a view of an order system of the main nozzles in the main nozzle block according to the embodiment of FIG. 3, viewed from direction B of FIG. 2.
Figure 6:
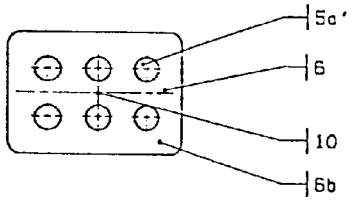
FIG. 6 is a view of an order system of the main nozzles in the main nozzle block according to the embodiment of FIG. 5, viewed from direction B of FIG. 2.
Figure 8:
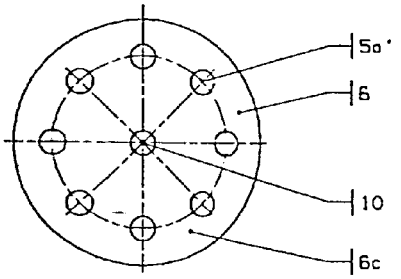
FIG. 8 is a view of an order system of the main nozzles in the main nozzle block according to the embodiment of FIG. 7, viewed from direction B of FIG. 2.

As known, the main nozzle arrangement 5 forms a main nozzle block 6. The main nozzles 5*a* are arranged in the main nozzle block 6 according to a defined system. Examples of preferred embodiments of such defined systems are illustrated in FIGS. 4, 6 and 8. The main nozzles 5*a* are equipped with a blow pipe 5*b*. The yarn guiding duct 5*b*' extends through the main nozzles 5*a* and the pertaining blow pipe 5*b* along its length. The main nozzle block 6 and the free ends of the blow pipes 5*b* are carried by a holder 13 which establishes the connection to the reed stay 2. The connection devices 14 are illustrated symbolically.

A prenozzle arrangement 8 is positioned in front of the main nozzle arrangement in the weft direction 7.

The prenozzle arrangement 8 is stationarily connected with a carrier 12 fixed to the loom. A holder 15 accommodates a prenozzle block 9, in which, according to the invention, prenozzles 8*a* having a blow pipe 8*b* are integrated, specifically according to an order system which corresponds to that of the main nozzles 5*a* in the main nozzle block 6. The holder 15 is connected with the carrier 12 via symbolically illustrated connection devices 16.

Figure 3:
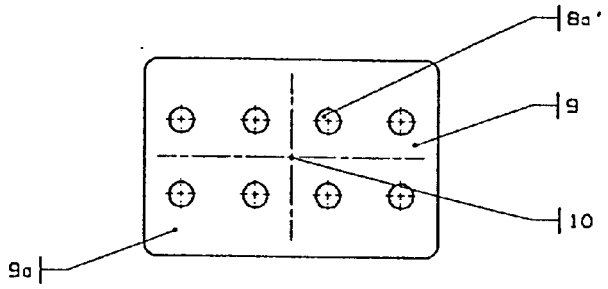
FIG. 3 is a view of an order system of the prenozzles in the prenozzle block according to one preferred embodiment of the present invention, viewed from direction A of FIG. 2.
Figure 5:
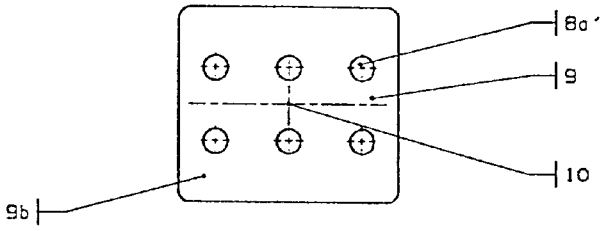
FIG. 5 is a view of an order system of the prenozzles in the prenozzle block according to another preferred embodiment of the present invention, viewed from direction A of FIG. 2.
Figure 7:
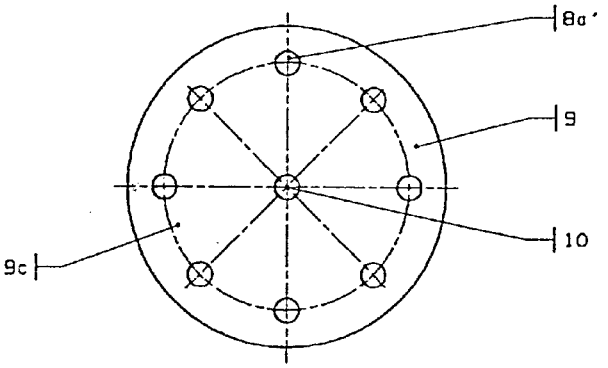
FIG. 7 is a view of an order system of the prenozzles in the prenozzle block according to another preferred embodiment of the present invention, viewed from direction A of FIG. 2.

Examples of preferred embodiments of the order system of the prenozzles 8*a* in the prenozzle block 9 are illustrated in FIGS. 3, 5 and 7.

In FIG. 2, the reed stay 2 with the superstructures 1, 5, and 13 is situated in the picking position of the weft yarn 3. A prenozzle arrangement 8 is permanently situated in this position, whereby the yarn guiding ducts 5*b*' and 8*b*' are situated opposite one another in an aligned manner. In other words, the longitudinal center axes 5*a*' of the main nozzles 5*a* are aligned with the longitudinal center axes 8*a*' of their respective prenozzles.

This type of an arrangement also has the advantage that, at the point in time of the picking of the weft yarn, deflections of the weft yarns at the outlet of the blow pipes 8*b* and at the inlet of the main nozzles 5*a* are eliminated and that, as mentioned above, because of an identical order system between the main nozzles and the prenozzles, and the combination of all prenozzles in a prenozzle block, the expenditures for the aligned adjusting of the prenozzles with the main nozzles are minimized.

As shown in the preferred embodiment of FIGS. 3 and 4, the prenozzles 8*a* are arranged in a geometric configuration in the prenozzle block 9*a* (FIG. 3) which corresponds with the geometric configuration of the main nozzles 5*a* in the main nozzle block 6*a* (FIG. 4). Since the weft yarns converge in weft direction 7 as they approach the weaving reed 1 (see FIG. 1), the relative spacing of the prenozzles 8*a* with respect to the longitudinal center axis 10 of the prenozzle block 9*a* is greater than the relative spacing of the main nozzles 5*a* with respect to the longitudinal center axis 10 of the main nozzle block 6*a*. The longitudinal center axis of the main nozzle block 6 is coaxial with the longitudinal center axis of the prenozzle block 9 in the picking position shown in FIG. 2.

FIGS. 5 and 6 show another preferred embodiment of the prenozzle block 9*b* (FIG. 5) and the corresponding main nozzle block 6*b* (FIG. 6).

FIGS. 7 and 8 show another preferred embodiment of the prenozzle block 9*c* (FIG. 7) and the corresponding main nozzle block 6*c* (FIG. 8). In this preferred embodiment, the prenozzles 8*a* are regularly spaced about the longitudinal center axis 10 (i.e., the angles defined by adjacent ones of the prenozzles 8*a* and the longitudinal center axis are identical). Accordingly, the prenozzle block 9*c* of FIG. 7 may be rotatably mounted on the carrier 12 such that any selected one of the prenozzles 8*a* can be aligned with any selected one of the main nozzles 5*a*.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An air nozzle weaving loom, having a reed stay which carries a weaving reed and which uniformly swings between a picking position and a beating up position about a longitudinal axis of a driving shaft in order to pick and beat up weft yarns, having a first nozzle arrangement including a plurality of main nozzles having respective main nozzle blow pipes, the main nozzles being positioned in a main nozzle block in a given geometric configuration, and the main nozzle block being fixedly connected with the reed stay, and having a second stationary nozzle arrangement which is situated in front of the first nozzle arrangement in a weft direction and includes a plurality of prenozzles with respective prenozzle blow pipes, a yarn guiding duct of each of said prenozzle blow pipe being aligned in a weft yarn picking position with a respective yarn guiding duct of the main nozzle blow pipe, opposite the respective main nozzle, wherein the prenozzles with the prenozzle blow pipes are positioned in a prenozzle block in a geometric configuration which corresponds to said given geometric configuration of the main nozzles such that an alignment of the yarn guiding duct of a single one of said prenozzles with the yarn guiding duct of a corresponding one of the main nozzles effects an alignment of all of the yarn guiding ducts of the prenozzles with the corresponding main nozzles, the prenozzle block being connected with a weaving loom carrier.

2. A weaving loom according to claim 1, wherein the given geometric configuration comprises an arrangement of longitudinal center axes of the prenozzles and the main nozzles symmetrically to a longitudinal center axis of the prenozzle block and the main nozzle block.

3. A weaving loom according to claim 2, wherein the longitudinal center axes are situated on a rectangular path of a rectangular surface, which is aligned with the weft direction, of the prenozzle block and the main nozzle block.

4. A weaving loom according to claim 2, wherein the longitudinal center axes are situated on a square path of a square surface, which is aligned with the weft direction, of the prenozzle block and the main nozzle block.

5. A weaving loom according to claim 2, wherein the longitudinal center axes are situated on a circular path of a circular surface, which is aligned with the weft direction, of the prenozzle block and the main nozzle block.

6. A weaving loom according to claim 5, wherein the prenozzle block is arranged to be rotatable about said longitudinal center axis of the prenozzle block such that the longitudinal center axis of each of said prenozzles can be aligned with the longitudinal center axis of any one of said main nozzles.

7. An arrangement of main nozzles and prenozzles in an air weaving loom, comprising:

a main nozzle block including a plurality of main nozzles extending therethrough in a weft direction, said plurality of main nozzles being arranged in a given geometric configuration with respect to a longitudinal center axis of said main nozzle block;

a prenozzle block arranged upstream of said main nozzle block with respect to said weft direction, said prenozzle block including a plurality of prenozzles extending therethrough in said weft direction, said plurality of prenozzles being arranged in a geometric configuration with respect to a longitudinal center axis of said prenozzle block which corresponds to said given geometric configuration of said main nozzles.

8. An arrangement according to claim 7, wherein said main nozzle block is arranged to be movable between a picking position and a beating up position, said prenozzle block being arranged such that said prenozzles are aligned with said main nozzles when said main nozzle block is in said picking position.

9. An arrangement according to claim 8, wherein said plurality of prenozzles are arranged equidistant from said longitudinal center axis of said prenozzle block and are arranged such that angles defined by adjacent ones of the prenozzles and the longitudinal center axis are identical.

10. An arrangement according to claim 9, wherein said prenozzle block is arranged to be rotatable such that any selected one of said prenozzles can be aligned with any selected one of said main nozzles when said main nozzle block is in said picking position, wherein during said alignment, other ones of said prenozzles are automatically aligned with corresponding other ones of said main nozzles.

11. A prenozzle arrangement for an air weaving loom having a main nozzle block including a plurality of main nozzles extending therethrough in a weft direction, said plurality of main nozzles being arranged in a given geometric configuration with respect to a longitudinal center axis of said main nozzle block, said prenozzle arrangement comprising:

a prenozzle block to be arranged upstream of said main nozzle block with respect to said weft direction, said prenozzle block including a plurality of prenozzles extending therethrough in said weft direction, said plurality of prenozzles being arranged in a geometric configuration with respect to a longitudinal center axis of said prenozzle block which corresponds to said given geometric configuration of said main nozzles.

12. A prenozzle arrangement according to claim 11, wherein said main nozzle block is arranged to be movable between a picking position and a beating up position, said prenozzle block being arranged such that said prenozzles are aligned with said main nozzles when said main nozzle block is in said picking position.

13. A prenozzle arrangement according to claim 12, wherein said plurality of prenozzles are arranged equidistant from said longitudinal center axis of said prenozzle block and are arranged such that angles defined by adjacent ones of the prenozzles and the longitudinal center axis are identical.

14. A prenozzle arrangement according to claim 13, wherein said prenozzle block is arranged to be rotatable such that any selected one of said prenozzles can be aligned with any selected one of said main nozzles when said main nozzle block is in said picking position, wherein during said alignment, other ones of said prenozzles are automatically aligned with corresponding other ones of said main nozzles.

15. A method of arranging a plurality of prenozzles in a prenozzle block in an air weaving loom having a main nozzle block including a plurality of main nozzles extending therethrough in a woof direction, said plurality of main nozzles being arranged in a given geometric configuration with respect to a longitudinal center axis of said main nozzle block, said method comprising:

providing a prenozzle block having a longitudinal center axis; and arranging a plurality of prenozzles in said prenozzle block in a geometric configuration with respect to said longitudinal center axis which corresponds to said given geometric configuration of the main nozzles.

16. A method according to claim 15, wherein said main nozzle block is arranged to be movable between a picking position and a beating up position, said method further comprising arranging said prenozzle block on said air weaving loom such that said prenozzles are aligned with said main nozzles when said main nozzle block is in said picking position.

17. A method according to claim 16, wherein in said arranging step, said plurality of prenozzles are arranged equidistant from said longitudinal center axis and are arranged such that angles defined by adjacent ones of the prenozzles and the longitudinal center axis are identical.

18. A method according to claim 17, wherein said prenozzle block is is arranged to be rotatable on said air weaving loom such that any selected one of said prenozzles can be aligned with any selected one of said main nozzles when said main nozzle block is in said picking position, wherein during said alignment, other ones of said prenozzles are automatically aligned with corresponding other ones of said main nozzles.

* * * * *